United States Patent [19]

Drugge

[11] 3,980,466

[45] Sept. 14, 1976

[54] METHOD OF OPERATING A SHAFT FURNACE FOR THE PRODUCTION OF SINTERED IRON ORE PELLETS

[75] Inventor: Bengt Roland Drugge, Malmberget, Sweden

[73] Assignee: Luossavaara-Kiirunavaara Aktiebolag, Stockholm, Sweden

[22] Filed: Dec. 24, 1974

[21] Appl. No.: 536,306

[30] Foreign Application Priority Data

Dec. 12, 1973 Sweden ..... 7317496/3

[52] U.S. Cl. ..... 75/5

[51] Int. Cl.[2] ..... C21B 1/10

[58] Field of Search ..... 75/5

[56] References Cited

UNITED STATES PATENTS

| | | | |
|---|---|---|---|
| 1,447,071 | 2/1923 | Giesecke | 75/5 |
| 2,744,743 | 5/1956 | Beggs et al. | 75/5 |

*Primary Examiner*—M. J. Andrews

*Attorney, Agent, or Firm*—Haseltine, Lake & Waters

[57] ABSTRACT

In a method of operating a shaft furnace for the production of sintered iron ore pellets, in which the pellets are fired by introducing hot gas at the level of the furnace adjacent the opening for introducing the pellets to be fired and located at the top of the furnace and cooling air for cooling the pellets after having been heated by the hot gas is introduced into the shaft at the bottom thereof to pass upwardly through the shaft while cooling the pellets, the improvement of applying a substantial portion of the coolant air through air inlet channels distributed around the circumference of the shaft at a level of the shaft located between the bottom opening of the shaft and the burner openings at a substantial distance from both said openings as compared with the distance between the openings, to provide a temperature distribution of the coolant air flowing through the shaft such that the temperature of the coolant air flowing along and in the vicinity of the shaft adopts a value which is substantially lower around the circumference of the shaft than at the central parts of the shaft. A shaft furnace having a port for introducing iron ore pellets to be sintered in the furnace at the top of the furnace shaft, ports distributed around the circumference of the shaft adjacent the top port thereof for introducing hot gas for heating the pellets to be sintered, a port located at the bottom of the shaft for discharging sintered pellets and introducing coolant air to cool the pellets after sintering during descent thereof throught the shaft, and means for introducing coolant air throught ports distributed around the circumference of the shaft and located between the burner ports and the bottom port of the furnace at a distance from both.

4 Claims, 5 Drawing Figures

Fig. 3
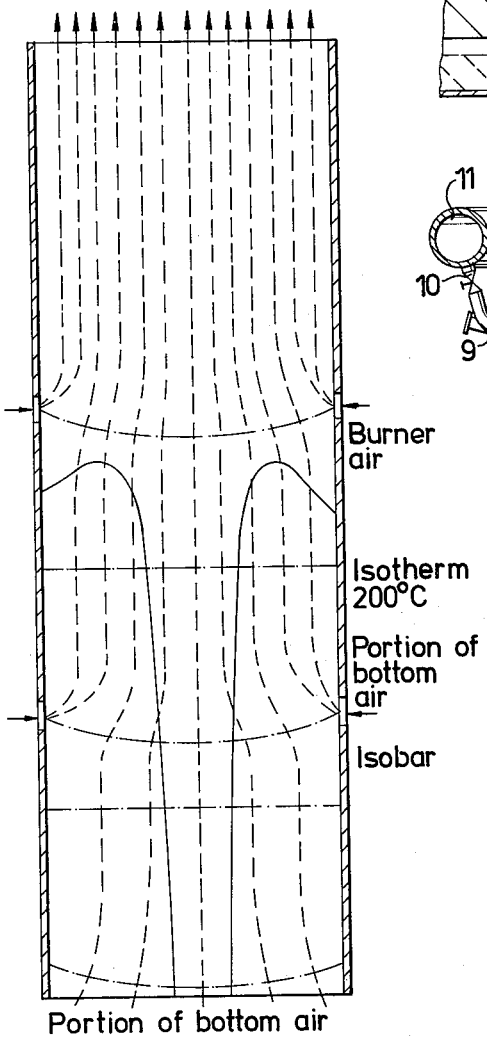
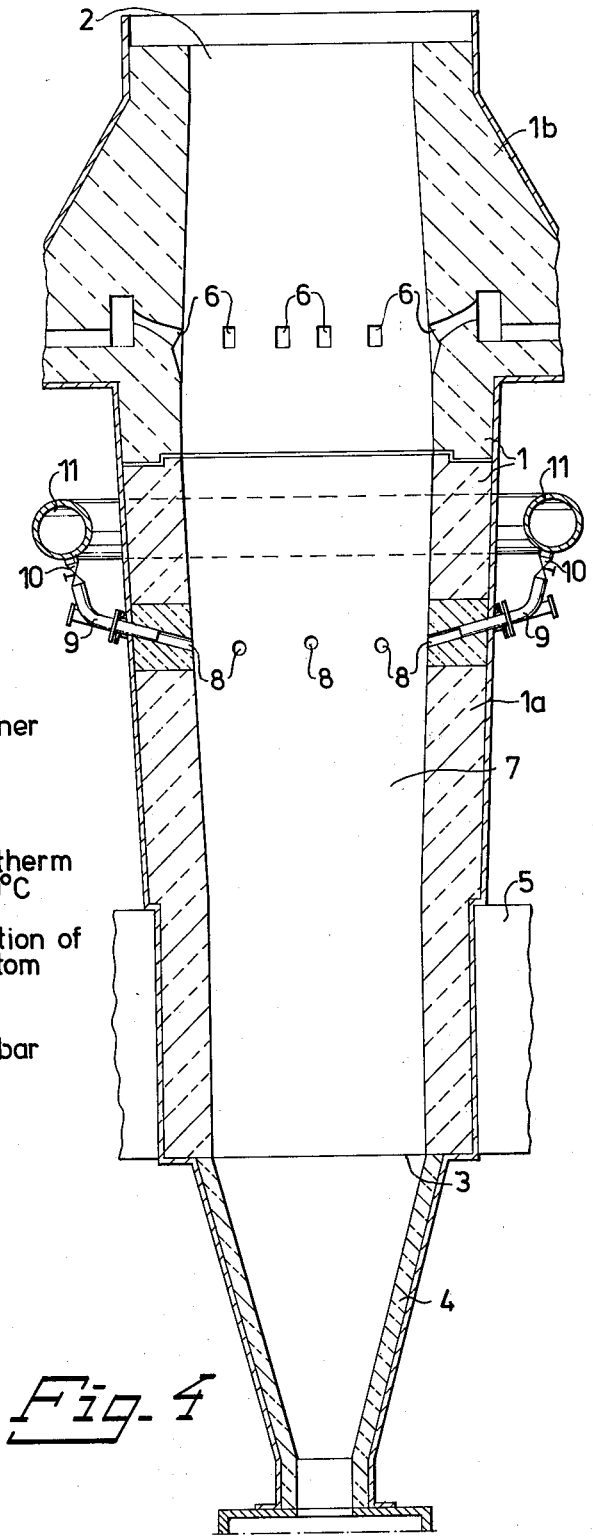
Fig. 4

METHOD OF OPERATING A SHAFT FURNACE FOR THE PRODUCTION OF SINTERED IRON ORE PELLETS

Shaft furnaces for sintering iron ore pellets have during recent years been improved in many respects. In particular, this is true for so called sinking in the furnace, that is, by improved arrangement of bottom air ducts, sinter rakers and shape of shaft, a comparatively even flow of material as seen across the shaft has been obtained. A further important improvement relates to the introduction of burner air to heat the pellets to be sintered in the furnace by means of an annular air channel surrounding the walls of the shaft and being in communication with burner ports distributed around the shaft and opening out into the shaft in every wall thereof.

A severe drawback has however remained, in that a distorted distribution of the air flow in the cooling zone of the furnace by the air flow proceeding aslant the vertical axis of the furnace is followed by a low yield of the physical heat of the pellets, resulting in a high temperature of the discharged pellets and, correspondingly, high fuel consumption.

By investigation leading to the invention disclosed in the following description, it has been evidenced that a substantial improvement of the shaft furnace process in these respects is attainable by means of the present invention.

Thus, it is an object of the present invention to operate a shaft furnace for sintering iron ore pellets, in respect of the coolant air admission in particular, in such a manner that the mentioned drawbacks are diminished. A further object of the invention is to provide a shaft furnace for executing the invention.

Earlier investigations of shaft furnaces of the kind from a heat technical and flow technical point of view show that, in the cooling zone of the furnace, a tendency is always present that an obliquely directed flow of air develops. This is due to the fact that the air flow resistance is lowest in cold ranges and that consequently the cold bottom air is conducted into the product under treatment in the furnace in cold flow strokes.

Figure 1:
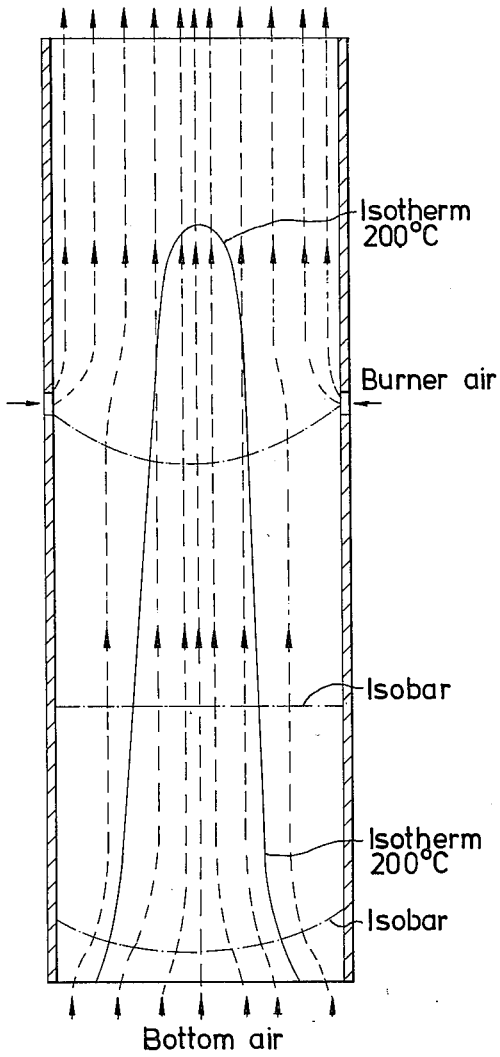
PRIOR ART Fig. 1
Figure 2:
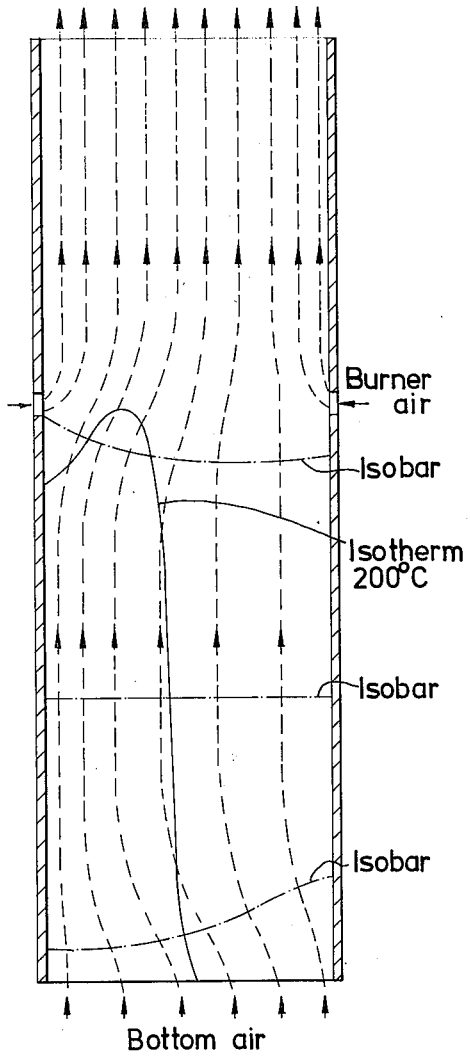
PRIOR ART Fig. 2
Figure 5:
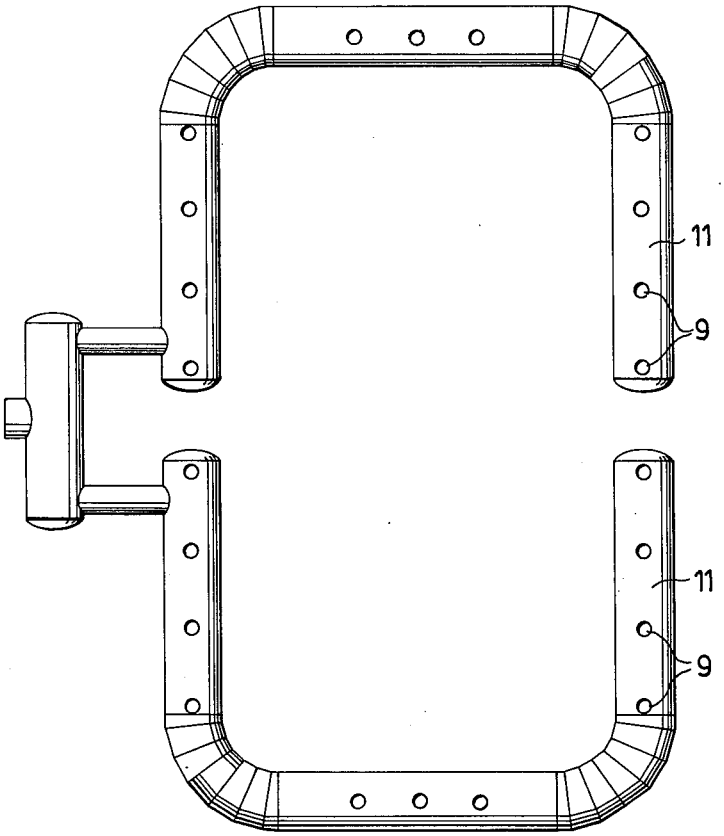

The invention is further illustrated with reference to the accompanying drawings, in which FIGS. 1 and 2 illustrate circumstances prevailing in known methods for admitting required cooling air during operation of a shaft furnace for producing sintered ore pellets, FIG. 3 illustrates the general situation when proceeding according to the method of the present invention, and FIGS. 4 and 5 illustrate an embodiment of a shaft furnace comprising means for executing the invention, the embodiment being illustrated only to an extent necessary for understanding the invention.

When operating shaft furnaces of the kind, mainly two types of air distribution patterns are as a rule obtained. In the first type the bottom air is concentrated into a cold jet at the center of the shaft, and in the second type the air is concentrated into a cold jet along one of the walls or cold jets along a number of walls of the shaft.

The first one of these cases is illustrated by FIG. 1 and the second by FIG. 2. FIGS. 1 and 2 are somewhat idealized, in that they show continuance states provided that the air supply at the bottom of the shaft is held perfectly uniform over the entire cross section of the shaft and that the product flow is even Both cases are characterized by being stable, meaning that there is no possibility without strong measures to change cold-air flows once developed in the goods passing through the furnace after starting up the furnace.

However, there is an important difference between the two cases. In the case illustrated by FIG. 1, in which a cold-air flow proceeds through the furnace at the center thereof, it is next to impossible to operate the furnace in a stable, well-established condition, due to the fact that the sintering zone within the furnace is steadily endangered by the cold-air jet and is easily broken through by the jet.

This situation often arises when starting up a furnace, for the reason that the bed of pellets to be sintered is then cold and that the heating up of the pellets starts adjacent the walls, a cold-air flow consequently and for obvious reasons developing at the center of the furnace. To eliminate such a cold-air jet through the furnace it is then usually necessary to restrict the quantity of bottom air considerably during a comparatively long period and very often it takes a number of weeks before an acceptable quality of sintered pellets is obtained. In this way it is possible to displace the cold-air jet developed at the center of the furnace from the center, the air flow then by and by ending up in the position illustrated by FIG. 2, that is, the cold-air flow proceeds mainly along one of the walls of the furnace.

In a conventional type of furnace with rectangular cross section the situation illustrated by FIG. 2 is usually characterized by about half of the pellet material being red-hot adjacent one of the furnace walls, any one of the walls at random, and sometimes changing from year to year, one side of the furnace however always being hotter than the opposite one.

A similar phenomenon has been observed for other types of furnaces as well. The location of the cold-air stroke may be different, in that it may develop along, for instance, a short-wall or along partition wall, if present.

Of particular interest in the present case is that the type of air flow illustrated by FIG. 2, that is, in which a cold-air flow proceeds along a wall in the furance, is the most favorable type of flow hitherto obtainable. Due to the fact, however, that the air flow proceeds highly unsymmetrically and that it is not feasible to introduce burner air used for the sintering procedure at locations where the cold-air strokes are located, large quantities of burner air have to be introduced to compensate for the cold air at one of the sides of the furnace and thus simultaneously introducing large quantitites of burner air on the hotter side of the furnace, which is already at a comparatively high temperature level by not being exposed to an adequate flow of cooling air.

Experience thus shows that cold-air streams along the walls are comparatively harmless for the process as such due to the fact that their influence on the process can more easily be compensated for by choice of the quantity of burner air. This state of things has led to the present invention which is defined in the accompanying claims.

A basis for the method of operating a shaft furnace for the production of sintered iron ore pellets is thus the understanding that such an operation of the furnace should be sought that the cold-air flow will dependably proceed along the walls of the furnace.

FIG. 3 illustrates this general principle and shows that cooling air is supplied to the furnace not only from the bottom of the furnace, but that at least a substantial part thereof is introduced at and along the walls of the furnace shaft. This may be provided for, for example, by means of an annular header duct extending around the furnace for supplying the cooling air and from which the air is introduced into the furnace shaft from the more or less vertical walls thereof. By such means it has proved possible to prevent cold-air jets from developing in the central parts of the shaft and, moreover, it is feasible in a comparatively short time by controlling the cooling air supply to eliminate a cold-air jet possibly arisen at the center of the shaft during a starting-up period.

To obtain a substantial improvement, as compared with an operation according to general principles hitherto belonging to the art, the following conditions should be satisfied:

The cooling air has to be supplied distributed around the entire periphery of the furnace. Thus, there should be no interruption of the cooling air supply along any part of the substantial length of the wall along the periphery of the furnace as compared with the length of the periphery. Otherwise hot-strokes in the product to be sintered may form at such interruptions, causing an unsymmetrical distribution of the coolant ascending through the shaft. Corresponding conditions are true for the supply of burner air higher up in the shaft. If the burner air ports of the furnace are not arranged comparatively close together around the periphery of the shaft, cold-air jets may develop between the ports and cut through the sinter zone located above the burner air ports.

The supply of cooling air, that is, "bottom air", in the hitherto conventional way, that is at the bottom of the shaft and distributed over the entire shaft cross section, has its influence on the descent of the treated product through the shaft. For this reason a part of the air supplied as coolant for the treated sintered product is supplied at the product discharge port of the shaft when executing the method according to the invention as well. How large a part of the cooling air should be supplied to the shaft at the walls thereof at a level of the shaft higher than the discharge port thereof, and how large a part thereof should be supplied through the discharge port of the shaft at the bottom thereof is dependent on the furnace construction and the temperature distribution in the shaft aimed at with respect to the process. At least 35 to 40% and preferably about 50% of the bottom air should be supplied along the shaft walls from air supply ports located above the bottom port of the shaft and distributed around the periphery of the shaft.

When executing the method according to the invention, the air distribution in the cooling zone of the shaft is still such that the intensity of the air flow vertically through the shaft is not constant over the entire cross section of the shaft. However, due to the air distribution provided for, the cold area in the shaft may be substantially increased, as compared with the situation in earlier used methods. Therefore the quantity of treated product discharged at the center of the cross section of the shaft at a higher temperature than the surrounding product is considerably much less than with earlier methods, the product discharged along one side wall of the furnace being, when executing methods hitherto known, considerably hotter than the product discharged at the opposite side of the furnace.

As a whole, this means that the quantity of burner air may be less, and the fuel consumption correspondingly less, to reach the required sintering temperature. Thus it has, in practice, been possible to decrease the fuel consumption up to about 50%. Since the supply of cooling air at the sidewalls of the shaft may and should preferably proceed at a substantial height in the shaft above the discharge port thereof, preferably at a level of at least one third and, especially, between half and two thirds of the shaft height between the discharge port at the bottom of the shaft and the level where the burner air required for the sintering is supplied, the air pressure required for the supply of cooling air will be considerably lower than in the case when the cooling air is supplied at the bottom of the shaft. Due to the fact that the mean temperature of the cooling zone is decreased, the required air pressure is correspondingly decreased. This is in spite of the fact that the total quantity of cooling air is larger when executing the invention at optimal operation conditions. Thus, it has been possible in practice to obtain a total decrease of about 30% of the power necessary for the generation of pressurized air for operating the furnace. Since the cost for air required for the process has a strong influence on the process cost, this means an additional improvement obtained by aid of the invention.

As further advantages of a secondary kind obtained by use of the invention, the following may be mentioned.

Because of the higher symmetry in temperature distribution obtained in the shaft, an improvement has been obtained with respect to wear of the vitreous material used in the shaft. The temperature expansion in the lower parts of the shaft is less and more symmetrical than when using earlier methods. The risk for smearing on the walls by material treated in the furnace is substantially avoided, and particularly so below the burner ports in the shaft, due to the fact that at least below the burner ports the wall temperature does not reach such high values as with earlier processes. The time period to reach a balanced sintering process after start-up is considerably decreased, and the process is controllable in such a manner that it proceeds far more stably than has been hitherto possible.

FIGS. 4 and 5 show, schematically, a shaft furnace for the production of sintered ore pellets according to the invention. In its general outlines the furnace is of conventional construction and consists of shaft walls 1, surrounding a shaft 7 of rectangular cross-section and having a pellet charge port 2 at the top of the shaft and a pellet discharge port 3 at the bottom of the shaft, opening into a feeder device for discharging the sintered pellets only the funnel shaped part 4 of which is represented on the drawing. As shown, the furnace has a lower part 1*a*, supported by a base 5, an upper part 1*b*, supported by an upper bed, not shown. In the upper part 1*b* of the furnace, a number of burner ports 6 of burners (not shown), arranged around the furnace shaft 7, substantially in a conventional manner for the supply of combustion products from the burners to the material to be sintered, open into the shaft 7. Pressurized air required for the combustion of fuel oil in the burners is supplied by pressurized air ducts 8.

In the hitherto conventional manner of operating a shaft furnace of this kind, air required for cooling the material treated in the furnace and heated to a temperature necessary for sintering the material is supplied at a comparatively high pressure at the bottom port 3 of the shaft, from whence it flows upwardly in counter-current to the material descending through the shaft to combine at a comparatively high temperature in the vicinity of the burner ports with the combustion gases to further ascend through the shaft together with these. In this conventional method, a situation as described with reference to FIGS. 1 and 2 may arise.

However, the furnace illustrated by FIG. 4 comprises means for supplying a substantial part of the air required for the cooling of the sintered material at a level in the shaft which is located at a substantial distance from the burner ports 6 as well as from the discharge port 3 of the shaft, preferably at at least one third and at most three-fourths of the distance between the burner ports 6 and the discharge port 3, from the discharge port 3. In the practical case the remaining distance between said means for supplying cooling air and the burner ports 6 should be at least about 3 meters. As mentioned before, the quantity of cooling air introduced at a comparatively high level above the bottom of the shaft should be at least 35 to 40% and preferably 50% of the total cooling air quantity, this air being a part of such air which, in sintering plants hitherto known, is usually called "bottom air".

The said means for supplying a substantial part of the cooling air comprises a plurality of air supply ports 8 distributed along the periphery of the furnace shaft at a mainly horizontal cross-section thereof, each of said supply ports 8 being connected to a pressurized air duct 9 which, as the case may be via a control valve 10, is connected to an air header 11 extending around the shaft and being so dimensioned relative to the air outlet duct connected thereto that pressure drops in the header 11 will be negligible relative to the pressure drops in the individual ducts from the header to the shaft. An embodiment of the such a header is illustrated by FIG. 5, showing a tubing consisting of two header tube portions 11 which together surround the walls of the rectangular shaft of the furnace and have outlet ports 11*a* in connection with each one duct 9, FIG. 4.

With an arrangement of the kind described and by supplying a selected quantity of cooliing air at the shaft walls along the entire periphery of the shaft, the favorable operating pattern described with reference to FIG. 3 is obtainable. Should a "mis-balance" as compared with the more or less ideal situation described with reference to FIG. 3 arise for some reason, corrections may be provided for in a comparatively short time by controlling the air supply through the ports 8 by means of pertaining valve 10.

We claim:

1. A method of operating a shaft furnace for the production of sintered ore pellets, in which ore pellets to be sintered descend through the shaft from a pellet supply port at the top of the shaft to a pellet discharge port at the bottom of the shaft, comprising heating the pellets to sintering temperature by supplying hot gas introduced into the shaft by means of a plurality of hot gas supply ports, distributed around the circumference of the shaft at a level below said pellet supply port, cooling the pellets heated by means of said hot gas supply by introducing cooling air into the shaft to pass upwardly through the shaft in counter-current to the pellets descending through the shaft after having been heated, and discharging the pellets at the bottom of the shaft after having been cooled by said cooling air, the improvement comprising introducing a portion of said cooling air at the bottom of said shaft at said pellet discharge port and introducing another portion of said cooling air into the shaft adjacent all surfaces defining the shaft through a plurality of air supply ports distributed about the entire circumference of the shaft at a level located between said pellet discharge port and said hot gas supply ports at a substantial distance as compared with the distance between said pellet discharge port and said hot gas supply ports from said pellet discharge port as well as from said hot gas supply ports, in order to provide such a temperature distribution of cooling air flowing through the shaft that the temperature of cooling air flowing along and in the vicinity of the shaft walls is lower around the entire circumference of the shaft than at the central parts of the shaft.

2. The method of claim 1, in which said cooling air introduced into the shaft at a level located between said discharge port and said hot gas supply ports is introduced at a level of between one-third and three-fourths of the distance between said discharge port and said hot gas supply ports above said discharge port.

3. The method of claim 2, in which said cooling air is introduced at a distance from said hot gas supply ports of at least 3 meters below said hot gas supply ports.

4. The method of claim 1, in which between 35 and 50% of said cooling air is introduced through said plurality of air supply ports located between said pellet discharge port and said hot gas supply ports and the rest of said cooling air is introduced at said pellet discharge port.

* * * * *